US010208946B2

(12) United States Patent
Roca et al.

(10) Patent No.: US 10,208,946 B2
(45) Date of Patent: Feb. 19, 2019

(54) LED HEATING LAMP AND FAN

(71) Applicants: Richard Roca, Miami, FL (US); Abraham Omid Ash, Miami, FL (US)

(72) Inventors: Richard Roca, Miami, FL (US); Abraham Omid Ash, Miami, FL (US)

( * ) Notice: Subject to any disclaimer, the term of this patent is extended or adjusted under 35 U.S.C. 154(b) by 0 days.

(21) Appl. No.: 15/953,246

(22) Filed: Apr. 13, 2018

(65) Prior Publication Data

US 2018/0231240 A1 Aug. 16, 2018

Related U.S. Application Data

(63) Continuation of application No. PCT/US2017/032330, filed on May 12, 2017.
(Continued)

(51) Int. Cl.
*F21V 33/00* (2006.01)
*F21S 8/02* (2006.01)
(Continued)

(52) U.S. Cl.
CPC ..... *F21V 33/0092* (2013.01); *F21K 9/23* (2016.08); *F21K 9/237* (2016.08); *F21S 8/026* (2013.01);
(Continued)

(58) Field of Classification Search
CPC .. F21V 33/0092; F21V 33/0096; F21V 25/10; F21K 9/237; F21S 8/02;
(Continued)

(56) References Cited

U.S. PATENT DOCUMENTS 7,341,469 B2 3/2008 Frye
7,990,252 B2 8/2011 Barton
(Continued)

FOREIGN PATENT DOCUMENTS

CN 202969790 U 6/2013
CN 203099585 U 7/2013
(Continued)

OTHER PUBLICATIONS

Richard Roca, Jul. 17, 2017, PCT/US2017/032330, Written Opinion of the International Searching Authority, pp. 1-6/.*

*Primary Examiner* — Alan B Cariaso
(74) *Attorney, Agent, or Firm* — Mark C. Johnson; Johnson | Dalal

(57) ABSTRACT

In combination with a building room having a ceiling defining a recessed lighting aperture and a cavity with a lighting receptacle disposed therein, wherein an improvement is disclosed that includes an LED lamp with a housing having a first end with a connector removably coupled to the light receptacle. The lamp has a second end defining a front face with an output vent disposed thereon. The light also has a heating element housed within the housing and electrically coupled to the lighting receptacle, a fan housed within the housing and electrically coupled to the lighting receptacle that is operably configured to emit air in an air-emitting direction substantially parallel to the longitudinal direction and through the heating element and the output vent, and has at least one LED bulb disposed on the rear face operably configured to emit light to an ambient environment.

17 Claims, 12 Drawing Sheets

Related U.S. Application Data

(60) Provisional application No. 62/392,888, filed on Jun. 15, 2016.

(51) Int. Cl.

| | |
|---|---|
| ***F21V 23/04*** | (2006.01) |
| ***F21V 25/10*** | (2006.01) |
| ***F21K 9/23*** | (2016.01) |
| ***F21K 9/237*** | (2016.01) |
| ***H04R 1/02*** | (2006.01) |
| ***F24H 3/02*** | (2006.01) |
| *F21Y 115/10* | (2016.01) |
| *F24H 3/04* | (2006.01) |

(52) U.S. Cl.
CPC ..... *F21V 23/045* (2013.01); *F21V 23/0464* (2013.01); *F21V 25/10* (2013.01); *F21V 33/0056* (2013.01); *F21V 33/0096* (2013.01); *F24H 3/022* (2013.01); *H04R 1/028* (2013.01); *F21Y 2115/10* (2016.08); *F24H 3/0405* (2013.01)

(58) Field of Classification Search
CPC ... F21S 8/026; F21S 8/03; F21S 8/031; F24H 3/022; F24H 3/0405
See application file for complete search history.

(56) References Cited

U.S. PATENT DOCUMENTS

| | | | | |
|---|---|---|---|---|
| 8,324,296 | B2 | 12/2012 | Kaneda et al. | |
| 8,696,176 | B2 * | 4/2014 | Davey | F21V 23/0442 362/373 |
| 8,864,447 | B1 | 10/2014 | Humphrey | |
| 9,951,911 | B2 * | 4/2018 | Dekker | F21K 9/237 |
| 2006/0193139 | A1 * | 8/2006 | Sun | F21K 9/233 362/373 |
| 2007/0109782 | A1 * | 5/2007 | Wolf | A01M 1/2083 362/253 |
| 2009/0059559 | A1 * | 3/2009 | Pabst | F21V 29/677 362/84 |
| 2010/0295436 | A1 * | 11/2010 | Horng | H01J 61/52 313/46 |
| 2011/0115358 | A1 * | 5/2011 | Kim | F21V 29/74 313/46 |
| 2011/0163676 | A1 | 7/2011 | Farzan et al. | |
| 2012/0195749 | A1 * | 8/2012 | Avedon | F04D 25/088 415/211.2 |
| 2014/0098303 | A1 * | 4/2014 | Kasuga | F21V 23/04 349/5 |
| 2015/0204533 | A1 | 7/2015 | Rosen et al. | |
| 2016/0261824 | A1 * | 9/2016 | Scalisi | H04N 7/142 |
| 2017/0198880 | A1 * | 7/2017 | Monteiro | F21V 7/0008 |

FOREIGN PATENT DOCUMENTS

| | | | | |
|---|---|---|---|---|
| EP | 1152193 | A1 | 11/2001 | |
| WO | WO 2017218108 | A1 * | 12/2017 | F21V 33/0092 |

* cited by examiner

100

100

100

LED HEATING LAMP AND FAN

CROSS-REFERENCE TO RELATED APPLICATION

This application claims priority to pending PCT Application Ser. No. PCT/US17/32330, filed May 12, 2017, which claims priority to U.S. Provisional Patent Application No. 62/392,888 filed on Jun. 15, 2016, the entirety of both are incorporated herein by reference.

FIELD OF THE INVENTION

The present invention relates generally to LED lamps, and, more particularly, to a LED lamp that is operably configured to house a fan and a heating element, and that is operably configured to emit light, air, and heat to an ambient environment.

BACKGROUND OF THE INVENTION

Recessed LED lights that are capable of emitting heat to an ambient environment are well known. Many of these known assemblies, however, require professional or expert installation, and are not capable of being retrofit into existing sockets by an amateur who is capable of installing a light bulb, but not capable of wiring a ceiling fan. Moreover, the known combination units and bulky and often require an external power source to the existing socket. Consequently, the combination units often require the removal of at least a portion of the ceiling in order to be installed in the ceiling.

Therefore, a need exists to overcome the problems with the prior art as discussed above.

SUMMARY OF THE INVENTION

The invention provides an improved LED heating lamp and fan that overcomes the hereinafore-mentioned disadvantages of the heretofore-known devices and methods of this general type and that is operably configured to couple with existing lighting sockets to be retrofit by an amateur, without the need for a wiring and installation professional.

With the foregoing and other objects in view, there is provided, in accordance with the invention, a combination with a building room having a ceiling defining a recessed lighting aperture and a cavity with a lighting receptacle disposed therein, wherein an improvement is disclosed that includes a LED lamp including a housing with a first end having a connector removably coupled to the light receptacle in a longitudinal direction and defining a rear face and a second end opposite the first end and defining a front face with an output vent disposed thereon. The LED lamp also includes a heating element housed within the housing that is electrically coupled to the lighting receptacle, a fan housed within the housing and electrically coupled to the lighting receptacle, wherein the fan is operably configured to emit air in an air-emitting direction substantially parallel to the longitudinal direction and through the heating element and the output vent, and includes at least one LED bulb disposed on the rear face of the housing and electrically coupled to the lighting receptacle, wherein the at least one LED bulb operably configured to emit light to an ambient environment.

In accordance with a further feature of the present invention, the connector is of an E27 configuration and is of a male screw base.

In accordance with yet another feature of the present invention, the fan is brushless.

In accordance with another feature, an embodiment of the present invention includes the at least one input vent disposed on the rear face of the housing. Moreover, the at least one input vent may be an air filter.

In accordance with yet another feature, an embodiment of the present invention includes at least one speaker tube mechanically coupled to the housing. A speaker may be disposed within the at least one speaker tube. Additionally, the speaker may be a Bluetooth speaker.

In accordance with a further feature of the present invention, the heating element is a PTC heating element.

In accordance with an additional feature, an embodiment of the present invention also includes a thermo breaker mechanically coupled to the heating element, wherein the LED lamp is operably configured to turn off when the heating element reaches a threshold temperature.

In accordance with another feature, an embodiment of the present invention also includes a photocell sensor disposed on the front face of the housing and an LED nightlight disposed on the front face of the housing and electrically coupled to the photocell sensor.

In accordance with a further feature of the present invention, the LED nightlight is operably configured to turn on when the photocell sensor detects that the ambient environment is dark.

In accordance with an additional feature of the present invention, the at least one LED bulb disposed on the rear face of the housing and is operably configured to emit light in a light-emitting direction opposite the air-emitting direction and toward the ceiling.

In accordance with a further feature of the present invention, the invention also includes a high-hat adapter mechanically coupled to the first end of the housing.

In accordance with a further feature of the present invention, the housing is made of a thermoplastic polymer and the thermoplastic polymer is polybutylene succinate.

In accordance with another feature, an embodiment of the present invention also includes a remote control that can operably configured to selectively control each of the heating element, the fan, and the at least one LED bulb.

Although the invention is illustrated and described herein as embodied in an improved LED heating lamp and fan, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a light receptacle disposed within a recessed lighting aperture in a ceiling.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
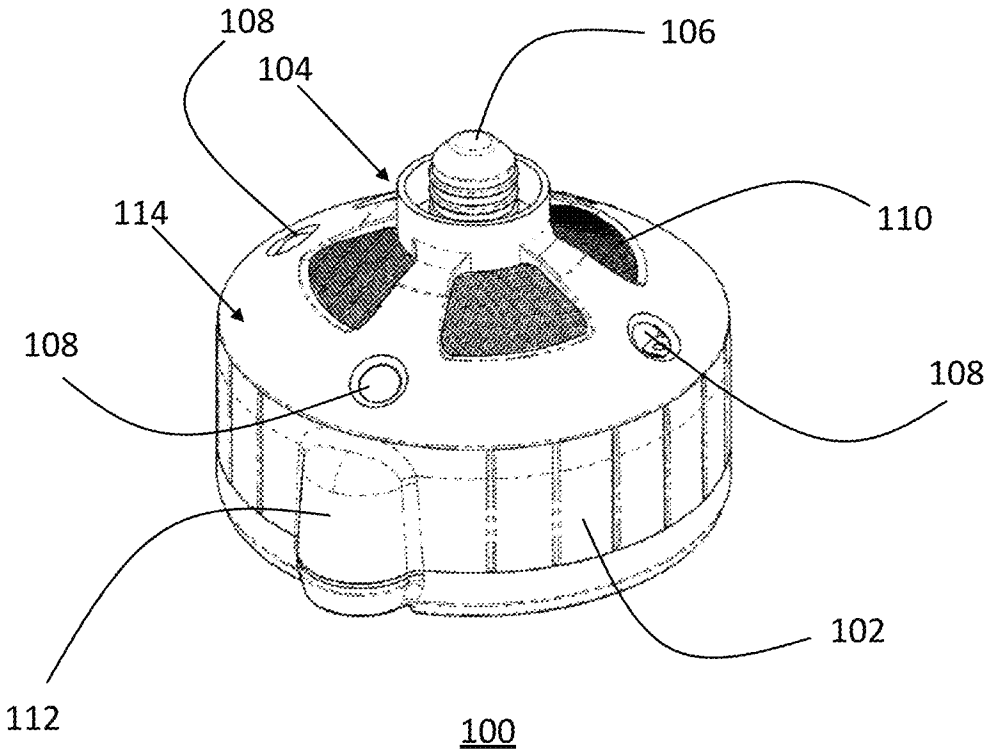
FIG. 1 is a downward-facing perspective view of an improved LED heating lamp and fan.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient improved LED heating lamp and fan that is operably designed to be used with a building room having a ceiling defining a recessed lighting aperture and a cavity with a lighting receptacle disposed therein. Embodiments of the invention provide a singular combination of a room heating element, a fan, and at least one LED bulb, that is sized and shaped to be installed in a pre-existing light socket, without the need for a professional installation. In addition, embodiments of the invention provide a speaker in combination with the heating element, fan, and at least one LED bulb, providing the advantages of each component in one retrofit combination device.

Figure 7:
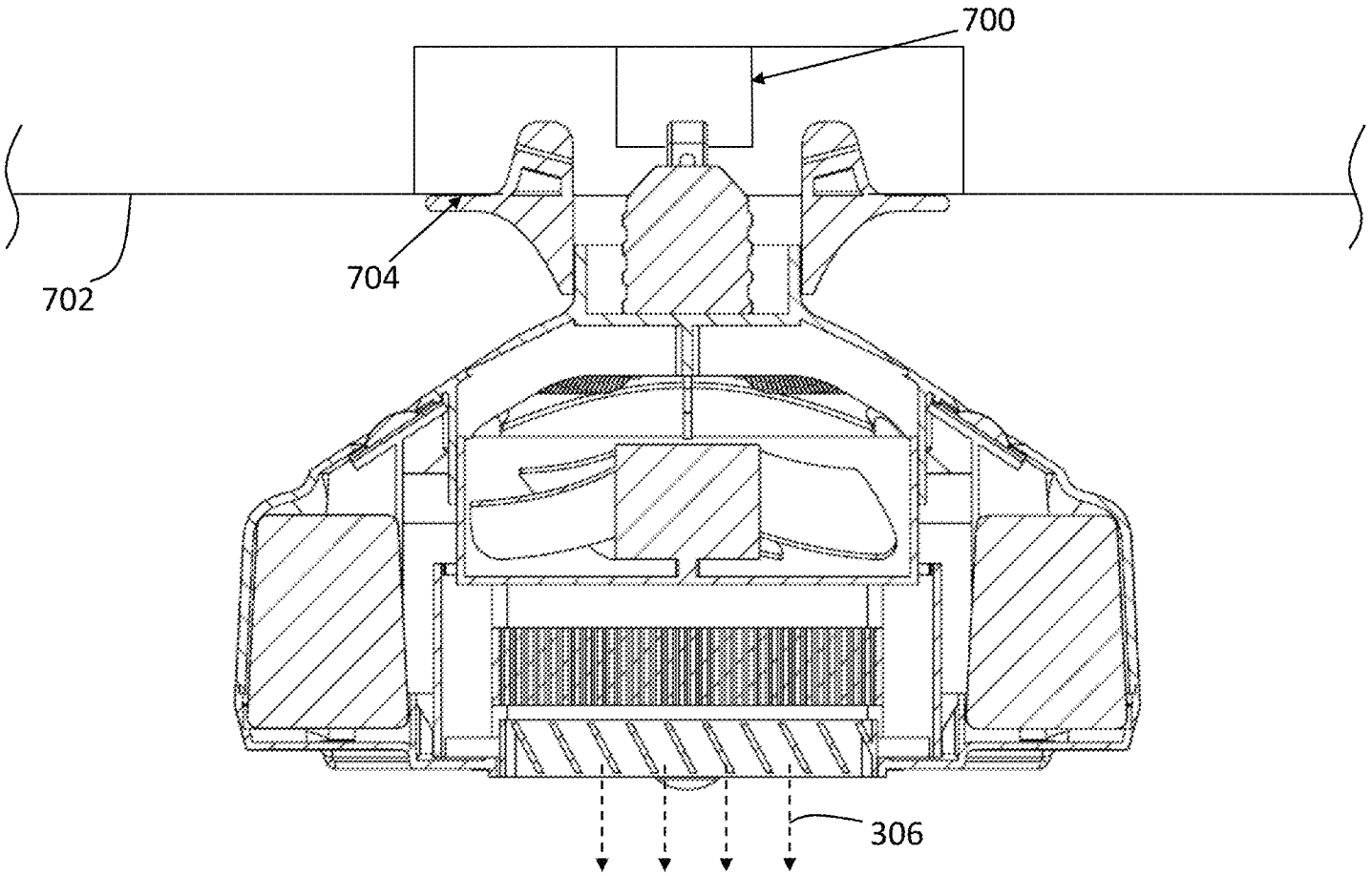
FIG. 7 is a cross-sectional view of the improved LED heating lamp and fan of FIG. 4 disposed within a recessed lighting aperture in a building room ceiling in accordance with the present invention.
Figure 8:
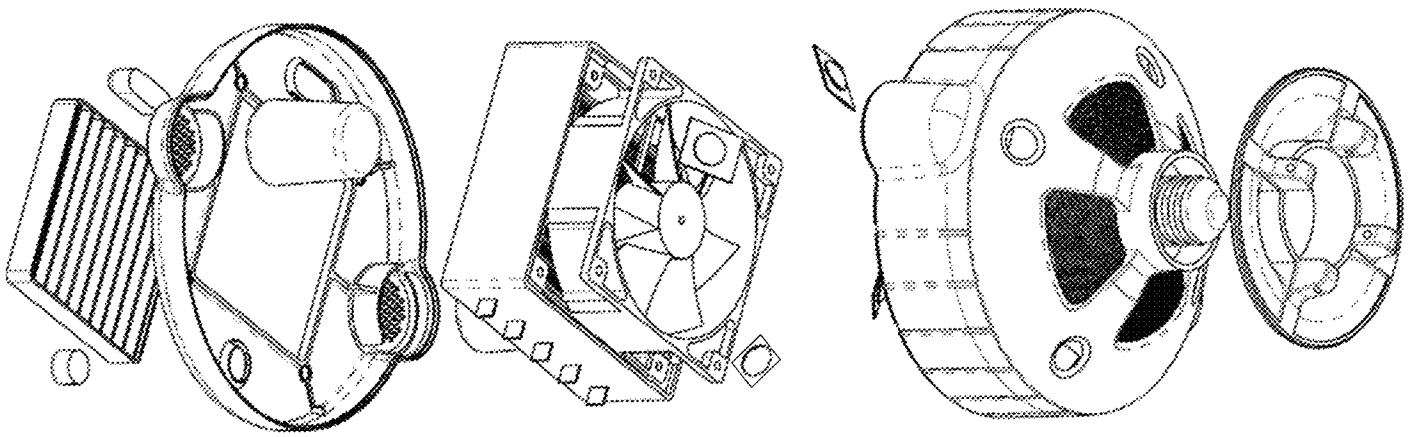
FIG. 8 is an exploded view of the improved LED heating lamp and fan of FIG. 4 in accordance with one embodiment of the present invention.
Figure 11:
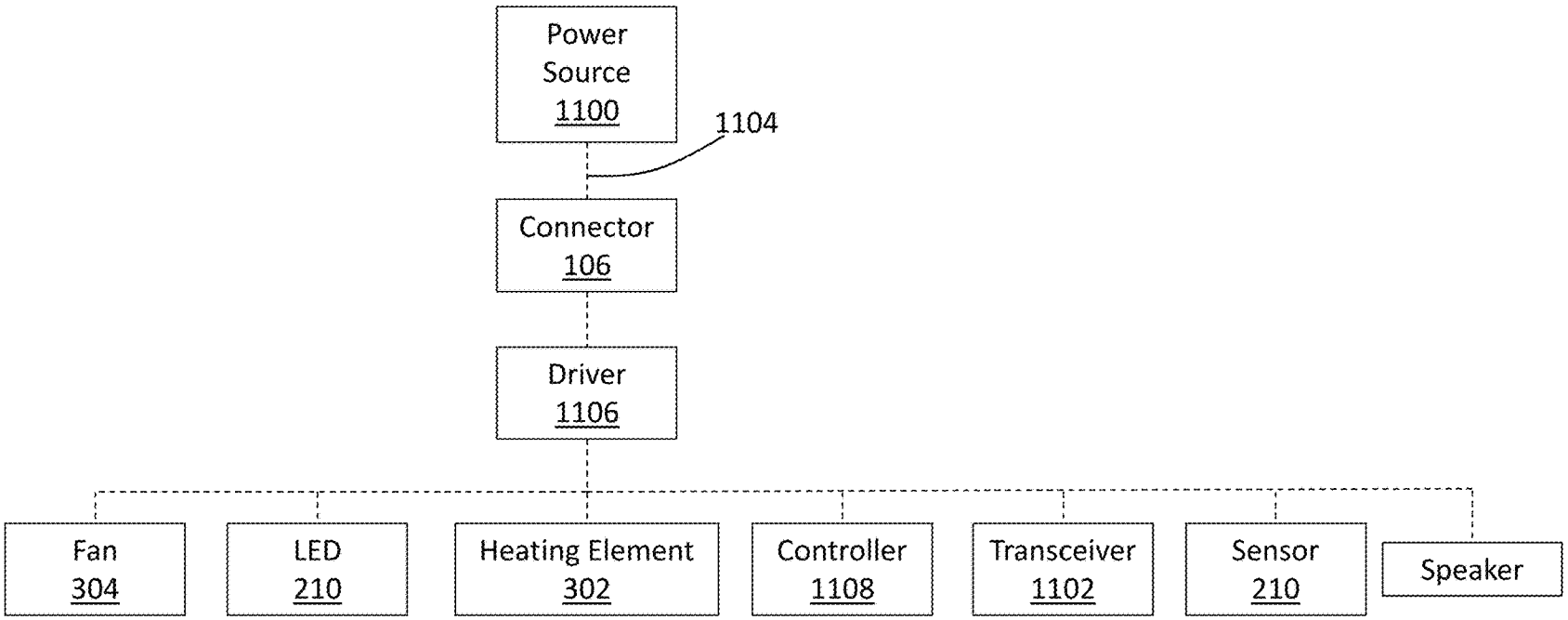
FIG. 11 depicts a high-level functional block diagram of the LED heating lamp and fan device in accordance with one embodiment of the present invention.

Referring now to FIG. 1 (in combination with FIGS. 7 and 11), one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of an improved combination LED heating lamp and fan 100, as shown in FIG. 1, includes a housing 102 having a first end 104.

The first end 104 may include a connector 106 removably and/or electrically coupled (representatively depicted by lines 1104 in FIG. 11) to a light receptacle 700 in a longitudinal direction, and may define a rear face 114 of the housing 102. In one embodiment, the connector 106 may be of an E27 configuration; however, it will be appreciated by those of skill in the art that the connector 106 could be of other configurations, such as E26, E39, E40, and the like. In a preferred embodiment, the connector 106 is of a male screw base, as depicted in FIG. 1, to couple to a female component of a light receptacle 700. Accordingly, the connector 106 may be removably coupled to the light receptacle in a longitudinal direction. In the preferred embodiment, the LED lamp 100 uses the light receptacle 700 as the primary source of power 1100 to the components of the LED lamp 100, without the need for an external power source.

In one embodiment, at least one input vent 110 may be disposed on the rear face 114, preferably disposed in a canted orientation with respect to the electrical receptacle 700. The at least one input vent 110 may be operably configured to receive air from the ambient environment and may have a grated cover disposed thereon for filtering purposes. Again, in a preferred embodiment, the rear face 114 may be angled with respect to the ceiling 702 or wall, such that at least a portion of the rear face 114 is extended away from the ceiling, rather than flush against the ceiling or wall. Advantageously, in an angled configuration, air can more easily enter the LED lamp 100 through the at least one input vent 110, since a gap exists between the housing 102 and the ceiling or wall. In one embodiment, the at least one input vent 110 may be an air filter that filters the air entering the LED lamp 100 for dust particles, among other impurities.

Figure 2:
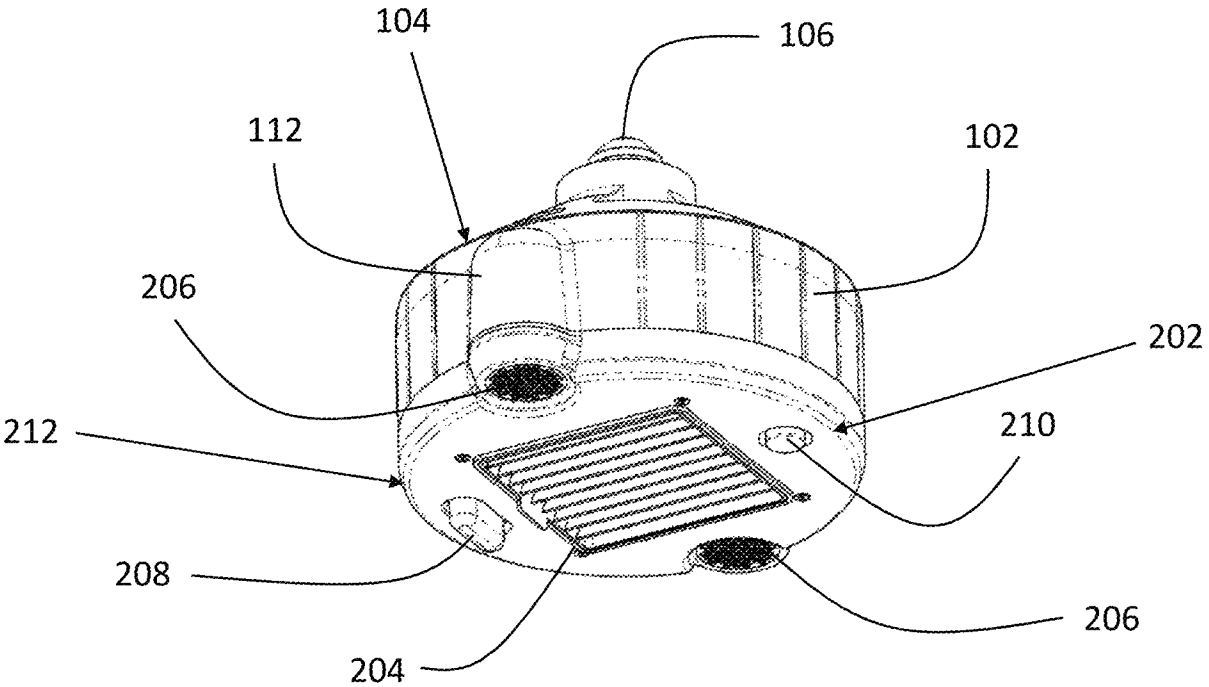
FIG. 2 is an upward-facing perspective view of the improved LED heating lamp and fan of FIG. 1 in accordance with the present invention.
Figure 3:
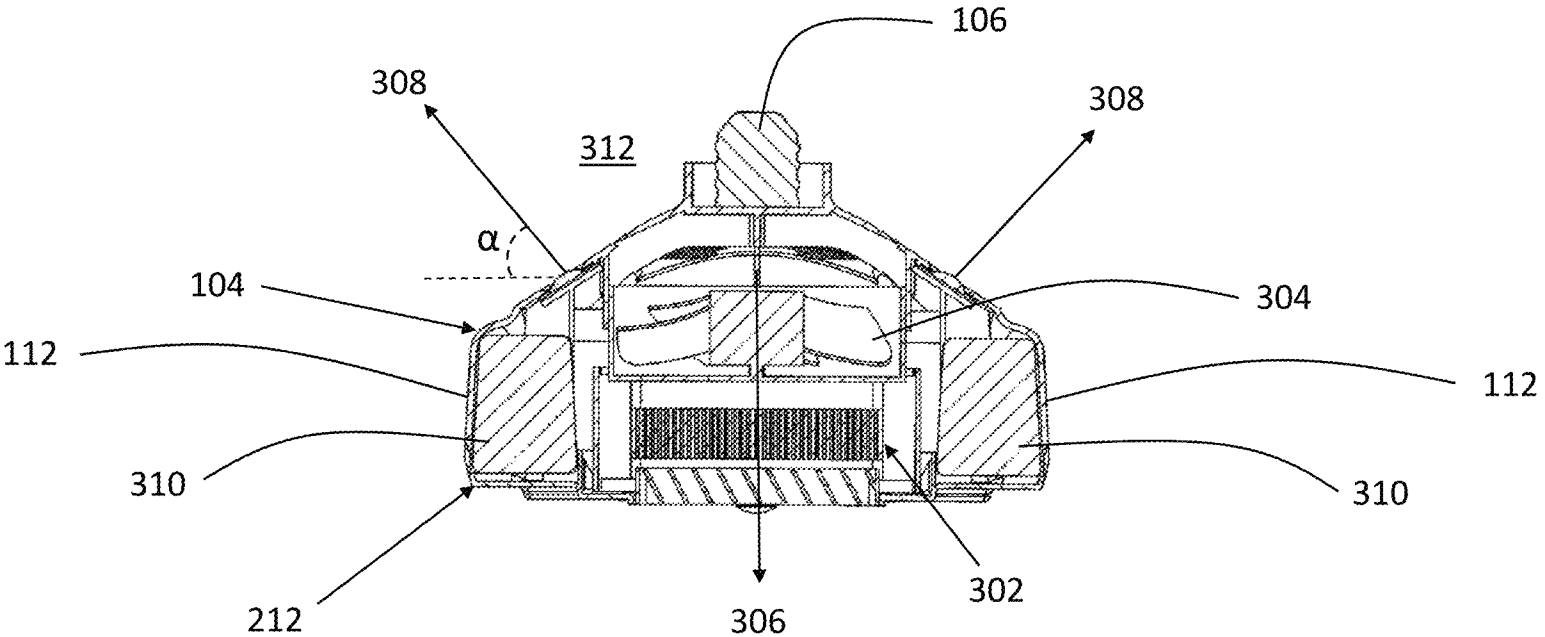
FIG. 3 is an elevational cross-sectional view of the improved LED heating lamp and fan of FIG. 1 in accordance with the present invention.
Figure 4:
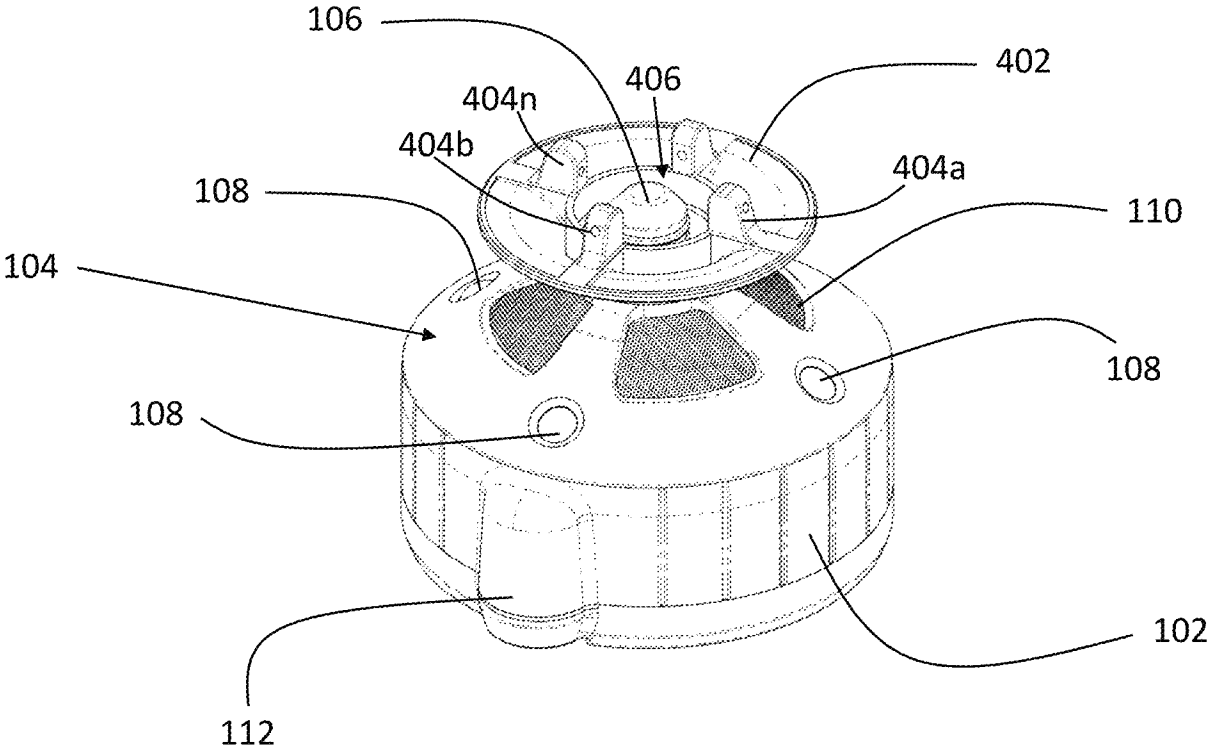
FIG. 4 is downward-facing perspective view of the improved LED heating lamp and fan of FIG. 1 with a high-hat adapter in accordance with an embodiment of the present invention.
Figure 5:
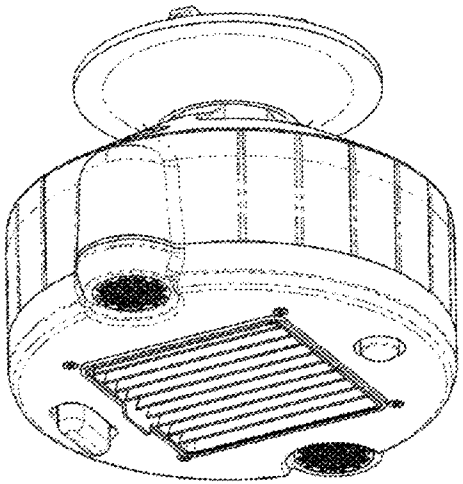
FIG. 5 is an upward-facing perspective view of the improved LED heating lamp and fan of FIG. 4 in accordance with the present invention.
Figure 6:
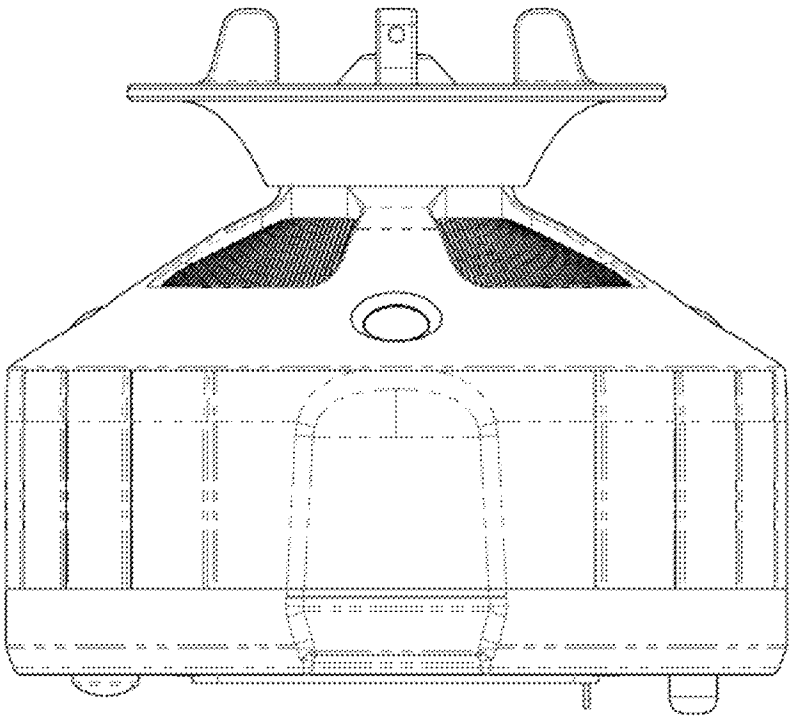
FIG. 6 is a side elevational view of the improved LED heating lamp and fan of FIG. 4 in accordance with the present invention.

Referring now to FIG. 2, the housing 102 is depicted in greater detail. In one embodiment, the housing 102 may include a second end 202 opposite the first end 104. The second end 202 may define a front face 212, and an output vent 204 may be disposed on the front face 212, allowing for the flow of air out of the output vent 204. In one embodiment, the output vent 204 may be selectively angled, so that a user may change the angle of the air that is emitted by the LED lamp 100. In an exemplary embodiment, the output vent 204 is a 45-degree vent that is removable, so that a user can remove the output vent 204 and reverse its configuration to emit air in a different direction and/or to permit straight airflow instead of directional airflow. In one embodiment, the housing 102 may be made of a thermoplastic polymer, and in a preferred embodiment, the housing 102 may be made of polybutylene succinate (PBS). In further embodiments, the output vent 204 may be disposed in a centered configuration on the housing.

Referring to FIGS. 1-3, 7, 9, and 11, the LED lamp 100 is depicted in greater detail. In one embodiment, the LED lamp 100 may include a heating element 302 that is housed within the housing 102 and is electrically coupled to the lighting receptacle 700 or other power source 1100. The heating element 302 may be made of a polymer material, and in a preferred embodiment, the heating element 302 is made of a 110V PTC heating element. The heating element 302 is positioned between the at least one input vent 110 and the output vent 204, and is capable of heating the air that flows through the LED lamp 100 from the at least one input vent 110 through the output vent 204. In one embodiment, the heating element 302 may be encased in glass or another insulating material, such that air traveling through the input vent 110 and contacting the heating element 302 does not emit an odor. In one embodiment, the LED lamp 100 may include a thermo breaker that is mechanically coupled to the heating element 302, which determines the temperature of the heating element 302 and automatically turns the LED lamp 100 off if a threshold temperature is reached. As used herein, "threshold temperature" means the maximum temperature of the heating element 302 allowed by the LED lamp 100 before the LED lamp 100 automatically shuts off.

The LED lamp 100 may include a fan 304 housed within the housing 102 and electrically coupled to the lighting receptacle 700. In one embodiment, the fan 304 may be brushless, advantageously creating a more energy efficient system, which may also lower the level of noise emitted by the LED lamp 100 and further prolong the life of the fan 304. In a preferred embodiment, the fan 304 may be a 3400 RPM 12V brushless case fan. The fan 304 may be operably configured to draw air in through the at least one input vent 110 and emit air out of the output vent 204, passing said air through the heating element 302. In a preferred embodiment, the fan 304 emits air in an air-emitting direction 306 that is substantially parallel to the longitudinal direction of the light receptacle and the connector 106, i.e., in general direction represented by arrow 306. The fan 304 may be positioned between the at least one input vent 110 and the heating element 302, such that the fan 304 forces air through the heating element 302, which can selectively heat the air before emitting the air through the output vent 204.

The LED lamp 100 may include at least one LED bulb 108 disposed on the rear face 114 of the housing 102 and electrically coupled to the lighting receptacle 700 or other power source 1100. The at least one LED bulb 108 may be operably configured to emit light to an ambient environment 312 surrounding the LED lamp 100. In a preferred embodiment, the at least one LED bulb 108 may be positioned at an angle with respect to the ceiling 702 or wall, advantageously emitting light in a light-emitting direction, represented by arrow 308, that is substantially opposite the air-emitting direction 306 and toward the ceiling or wall. Said another way, the light-emitting direction 308 extends away from the rear face 114 in a vertical-direction component that is disposed at a substantially 180-degree orientation with respect to the air-emitting direction 306. Accordingly, the at least one LED bulb 108 may emit light toward the ceiling or wall and may provide light in the ambient environment 312 surrounding the LED lamp 100 such that the room may be well-lit without the at least one LED bulb 108 shining directly toward the floor of the room and such that the directional flow of the air is uninhibited.

In some embodiments, housing includes a plurality of LED bulbs 108 encircling the connector 106 and disposed at an approximately 45-degree angle "α" with respect to the rear face 114 so as to effectively light the surrounding ceiling surface 702 defining a recessed lighting aperture 704. The lamp 100 may use four LED units 108 disposed on the rear face 114 of the housing 102 that may receive electricity through the connector 106, receiving socket 700, or from another power source 1100, e.g., an internal power source such as batteries. The LED units 108 may, however, be different sizes and/or shapes. Different mechanisms may be used to draw power from the power source 1100 to the electrical components disposed within and/or coupled to the housing 102. In at least one embodiment, a power connector 106 is formed as an integral part of the housing 102, and includes wire leads, e.g., 1104, for connecting the connector 106 to the electrical components. The LED lamp 100 may also utilize a driver circuit 1106 to convert incoming alternative current (AC), to direct current (DC). Said another way, the driver circuit 1106 may control power provided to LED(s) 108, one or more fans 304, one or more heating elements 302, the controller 1108, a transceiver 1102, the sensor 210, the speakers, or other electrical components disposed within the housing. Further, the driver 1106 may then be operatively and electrically coupled to the connector 106 or other power source 1100. In at least some embodiments, the driver 1106 is not a part of housing 102 and is instead connected between power connection 1100 and connector 106, and/or directly and electrically coupled to each electrical component.

Continuing further, the driver 1106 may include one or more electronic components to convert AC received from connector 106 or power source 1100 to DC. The driver 1106 may transmit the converted current to the LED units 108 and fan 304 to control operation of the LED units 108 and fan 304. In at least some embodiments, driver 1106 is configured to provide additional functionality to the LED lamp 100. For example, in at least some embodiments, driver 1106 is configured to dim the light produced by bulb 100, e.g., in response to receipt of a different current and/or voltage from power connector 106.

The fan 304, which could include a diaphragm or other air-moving device, generates air, e.g., rotates one or more blades, responsive to receipt of current from driver 1106. Rotation of fan 304 causes air to be drawn in through upper vent 110 on the rear face 114, through the internal heating element—thereby heating the air should the heating element 302 be activated, and through the lower vent 204. In at least some embodiments, the number of vents 110, 204 are dependent on the amount of air flow needed through the interior of LED bulb 100 to effectuate transfer of heat to the ambient environment, thereby heating a room of a building with approximately 350 square feet or less. In one embodiment, the fan 304 may draw heat from one or more heat sinks disposed on, for example, a rear surface 114 of the housing 102.

Figure 9:
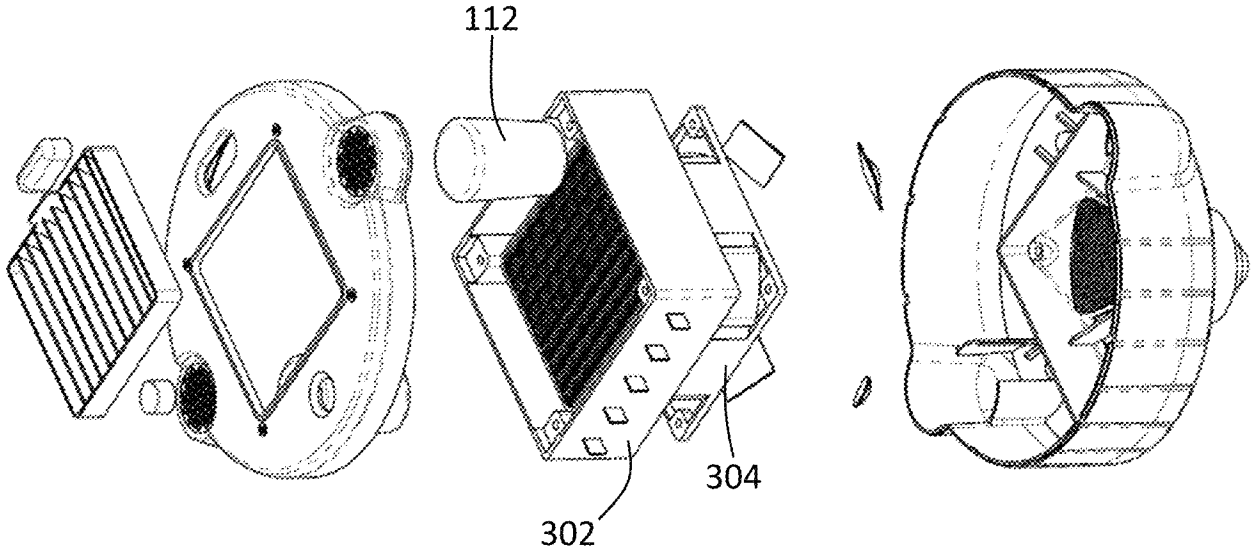
FIG. 9 is another exploded view of the improved LED heating lamp and fan of FIG. 4 in accordance with one embodiment of the present invention.
Figure 10:
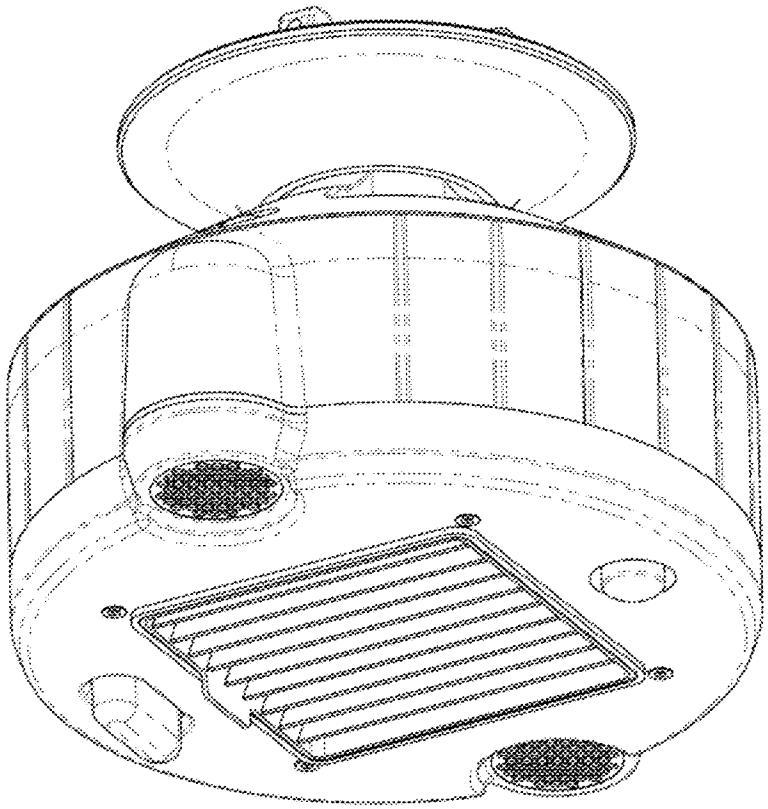
FIG. 10 is an upwardly looking perspective view of the improved LED heating lamp and fan of FIG. 4 in accordance with one embodiment of the present invention.

In one embodiment, the LED lamp 100 may include at least one speaker tube 112 mechanically coupled to the housing 102 and shaped to be received in various portions of the internal cavity of the housing 102 (as best seen in FIGS. 9-10). The speaker tube 112 may also advantageously be of a thermally insulating material to reduce the internal temperature within the tube 112 that may problematically cause overheating of the electrical components disposed therein. In one embodiment, a speaker 310 may be disposed within the at least one speaker tube 112. In a preferred embodiment, the speaker 310 may be a Bluetooth speaker, allowing the user to listen to music or other audio through the speaker 310 without a wired connection. In particular, this advantageously allows a user to install the LED lamp 100 in a bathroom, where a user may desire to listen to music or other audio while bathing or showering, yet effectively utilize other features of the LED lightbulb 100, such as the heating element 302.

In one embodiment, the LED lamp 100 may include a photocell sensor 210 disposed on the front face 212 of the housing 102. The photocell sensor 210 may be electrically coupled to a LED nightlight 208 that is operably configured to emit a low-level light that does not put strain on a user's eyes when adjusting from darkness to light. In one embodiment, the photocell sensor 210 may detect that the ambient environment is dark, and the LED nightlight 208 may be operably configured to turn on based on the detection of the photocell sensor 210.

Referring now to FIG. 4-7, the LED lamp 100 may include a high-hat adapter 402 mechanically coupled to the first end 104 of the housing 102. The high-hat adapter 402 is configured to provide support for the LED lamp 100 when coupled to the ceiling 702. The high-hat adapter 402 may include a plurality of retention members 404*a-n*, wherein the letter "n" represents any numeral greater than one. The plurality of retention members 404*a-n* may be disposed concentrically around the adapter aperture 406 defined by the adapter 402.

Figure 12:
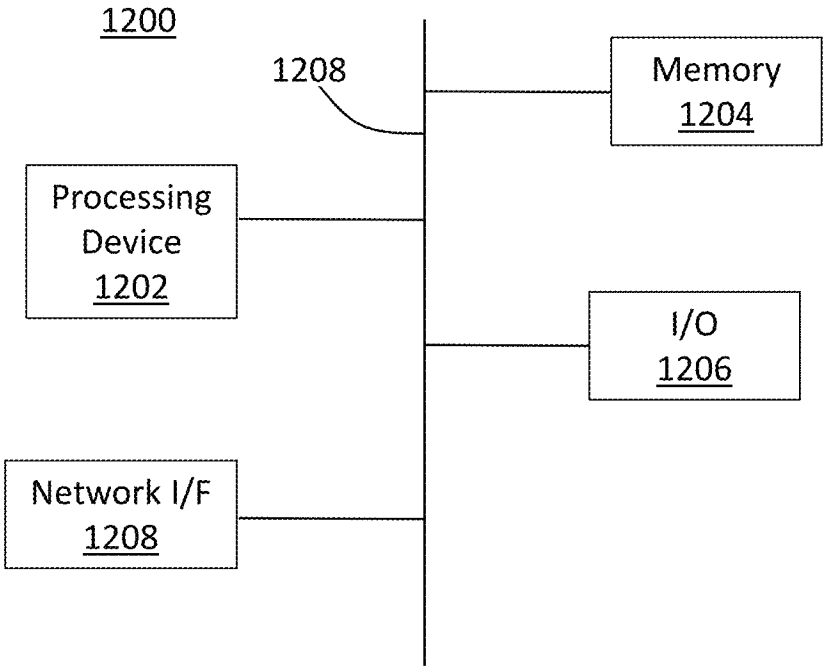
FIG. 12 depicts a high-level functional block diagram of a controller embodiment of a controller as a processing device for executing instructions.

With reference now to FIG. 12, which depicts a high-level functional block diagram of a controller embodiment 1200 of an exemplary controller 1108 as a processing device for executing a set of instructions. Controller embodiment 1200 may include a processing device 1202, a memory 1204, and an (optional) input/output (I/O) device 1206, such as a transceiver 1102, each communicatively coupled with a bus 1208. Controller embodiment 1200 optionally may include a network interface device 1208 communicatively coupled with bus 1208. The memory 1204 (also referred to as a computer-readable medium) is coupled to bus 1208 for storing data and information, e.g., instructions, to be executed by processing device 1202. The memory 1204 also may be used for storing temporary variables or other intermediate information during execution of instructions to be executed by processing device 1202. The memory 1204 may also comprise a read only memory (ROM) or other static storage device coupled to bus 1208 for storing static information and instructions for processing device 1202. The memory may include static and/or dynamic devices for storage, e.g., optical, magnetic, and/or electronic media and/or a combination thereof. In one embodiment, the memory 1204 may also include a set of instructions to activate the heating element and fan at a predetermined time, e.g., 7 AM, so that a room is effectively heated before a user enters the room.

The optional I/O device 1206 may include an input device, an output device, and/or a combined input/output device for enabling interaction with controller 1108. For example, I/O device 1606 may comprise a user input device such as a keyboard, keypad, mouse, trackball, microphone, scanner, or other input mechanism, and/or an output device such as a display, speakers, or other output mechanism. Additionally, I/O device 1206 may comprise an input and/or an output connection for interacting with one or more sensors, e.g., a light sensor, a temperature sensor, a motion sensor, etc.

Network I/F device 1208 may also include a mechanism for connecting to a network. In at least some embodiments, the network I/F device 1208 may comprise a wired and/or wireless connection mechanism. In at least some embodiments, processing device 1208 may communicate with another processing device, e.g., a computer system, via network interface device 1208. In at least some embodiments, controller embodiment 1200 may communicate with another controller embodiment via network interface device 1208. The network I/F device 1208 may also include a serial and/or a parallel communication mechanism. Non-limiting, exemplary embodiments of network I/F device 1208 include at least a digital addressable lighting interface (DALI), an RS-232 interface, a Universal Serial Bus (USB) interface, an Ethernet interface, a WiFi interface, a cellular interface, etc.

An improved LED heating lamp and fan has been disclosed that is operably designed to be used with a building room having a ceiling defining a recessed lighting aperture and a cavity with a lighting receptacle disposed therein so as to heat an entire room environment, e.g., a bathroom and the floor surface. The lamp also includes a room-heating element, a fan, and at least one LED bulb, that is sized and shaped to be installed in a pre-existing light socket, without the need for a professional installation. In addition, the LED bulb or lamp may also include a speaker in combination with the heating element, fan, and at least one LED bulb, providing the advantages of each component in one retrofit combination device.

What is claimed is:

1. In combination with a building room having a ceiling defining a recessed lighting aperture and a cavity with a lighting receptacle disposed therein, an improvement comprising:

a LED lamp including:

a housing with:

a first end having a connector removably coupled to the light receptacle in a longitudinal direction and defining a rear face; and a second end opposite the first end and defining a front face with an output vent disposed thereon;

a heating element housed within the housing and electrically coupled to the lighting receptacle;

a fan housed within the housing and electrically coupled to the lighting receptacle, the fan operably configured to emit air in an air-emitting direction substantially parallel to the longitudinal direction and through the heating element and the output vent; and at least one LED bulb disposed on the rear face of the housing in a spaced relationship with the ceiling defining a gap thereinbetween and in a canted orientation facing the ceiling and electrically coupled to the lighting receptacle, the at least one LED bulb operably configured to emit light to an ambient environment in a light-emitting direction opposite the air-emitting direction and toward the ceiling to shine light thereon.

2. The improvement of claim 1, wherein:
the connector is of an E27 configuration.

3. The improvement of claim 1, wherein:
the connector is of a male screw base.

4. The improvement of claim 1, wherein:
the fan is brushless.

5. The improvement of claim 1, further comprising:
at least one input vent disposed on the rear face of the housing.

6. The improvement of claim 5, wherein:
the at least one input vent is an air filter.

7. The improvement of claim 1, further comprising:
at least one speaker tube mechanically coupled to the housing.

8. The improvement of claim 7, further comprising:
a speaker disposed within the at least one speaker tube.

9. The improvement of claim 8, wherein:
the speaker is a Bluetooth speaker.

10. The improvement of claim 1, wherein:
the heating element is a 110V PTC heating element positioned between the fan and the output vent.

11. The improvement of claim 1, further comprising:
a thermo breaker mechanically coupled to the heating element, wherein the LED lamp is operably configured to turn off when the heating element reaches a threshold temperature.

12. The improvement of claim 1, further comprising:
a photocell sensor disposed on the front face of the housing; and
a LED nightlight disposed on the front face of the housing and electrically coupled to the photocell sensor.

13. The improvement of claim 12, wherein:
the LED nightlight is operably configured to turn on when the photocell sensor detects that the ambient environment is dark.

14. The improvement of claim 1, further comprising:
a high-hat adapter mechanically coupled to the first end of the housing.

15. The improvement of claim 1, wherein:
the housing is made of a thermoplastic polymer.

16. The improvement of claim 15, wherein:
the thermoplastic polymer is polybutylene succinate.

17. The improvement of claim 1, further comprising:
a remote control that can operably configured to selectively control each of the heating element, the fan, and the at least one LED bulb.

* * * * *